United States Patent [19]

Griffith

[11] Patent Number: 4,538,758

[45] Date of Patent: Sep. 3, 1985

[54] COMPOSITE CONTAINER

[75] Inventor: Edwin D. Griffith, Pemberville, Ohio

[73] Assignee: Automated Container Corporation, Orlando, Fla.

[21] Appl. No.: 309,595

[22] Filed: Oct. 8, 1981

Related U.S. Application Data

[63] Continuation of Ser. No. 83,915, Oct. 11, 1979, abandoned, which is a continuation of Ser. No. 920,764, Jun. 30, 1978, abandoned.

[51] Int. Cl.[3] ..... B65D 8/20; B21D 51/30

[52] U.S. Cl. ..... 229/4.5; 220/67; 220/450; 229/5.6; 413/4; 413/7

[58] Field of Search ..... 413/4.5, 7.8; 220/450, 220/456, 457, 66, 67; 229/4.5, 5.6

[56] References Cited

U.S. PATENT DOCUMENTS

| | | | |
|---|---|---|---|
| 2,633,095 | 3/1953 | Magill et al. | 413/5 |
| 3,073,480 | 1/1963 | Henchert | 220/67 |
| 3,156,401 | 11/1964 | Kraus | 229/4.5 |
| 3,157,336 | 11/1964 | Elam | 229/4.5 |
| 3,159,515 | 12/1964 | Dunlap, Jr. et al. | 229/4.5 X |
| 3,228,552 | 1/1966 | Rutledge | 229/5.6 X |
| 3,381,594 | 5/1968 | Ellerbrock et al. | 229/5.6 |
| 3,406,891 | 10/1968 | Buchner et al. | 220/67 X |
| 3,428,239 | 2/1969 | Wannamaker et al. | 220/66 X |
| 3,580,464 | 5/1971 | Griffith | 220/67 X |
| 3,700,524 | 10/1972 | Sato | 220/67 X |
| 4,055,271 | 10/1977 | Kronenwetter | 220/67 X |

*Primary Examiner*—Allan N. Shoap

*Attorney, Agent, or Firm*—Duckworth, Allen, Dyer & Pettis

[57] ABSTRACT

An improved hermetically sealed composite container formed by double-seaming a pair of compounded metal ends to extended length flanges on the opposite ends of a can body so that the compound is bonded to an inner liner on the can body to provide an effective seal. The compound material is placed in the seaming panel and curl area of the metal ends so as to provide a more extensive seal area when the metal ends are double-seamed with the extended flanges on the can body. The extended length flanges provide a considerably greater contact area between the can body inner liner and the metal ends when the metal ends are double-seamed to the can body.

6 Claims, 3 Drawing Figures

COMPOSITE CONTAINER

This is a continuation of application Ser. No. 083,915, filed Oct. 11, 1979 which is, in turn, a continuation of application Ser. No. 920,764, filed June 30, 1978, both now abandoned.

BACKGROUND OF THE INVENTION

This invention relates to containers and, more particularly, it relates to containers constructed of relatively low strength materials which are well-suited for packaging products requiring increased structural integrity and a hermetic seal, such as food and/or pressure-producing products.

It is very desirable to have an inexpensive container suitable for packaging various food items and pressure-producing products, such as carbonated beverages and beer. However, suitable containers for such products have been rather expensive due to the high strength characteristics necessary to maintain the hermetic seal.

In recent years, there have been introduced a number of different types of lightweight, composite containers constructed of low strength materials which are considerably less expensive than the commonly-used tin plate and aluminum containers. Such inexpensive containers normally are comprised of a cylindrical composite can body closed at both ends by metal caps which are attached to the body by a standard double-seaming method. In this standard double-seaming method, a curved extension of the metal end is folded over together with a flange portion on the fiber can body so as to form a double-seam joint. Such standard fiber containers have experienced difficulty in packaging certain food items and certain pressure-producing products because the joint between the metal ends and the fiber body has not exhibited sufficient strength to maintain a hermetic seal and to withstand the pressure of the products container therein. Thus, end seam failure was frequently experienced when attempts were made to use standard double-seamed fiber cans for packaging pressure-producing products. Thus, even though standard fiber containers are much lighter in weight and less expensive than the stronger metal containers, they have not been suitable for use in packaging certain food items and some pressure-producing products.

An improved hermetically sealed composite container was provided in my U.S. Pat. No. 3,580,464 which issued on May 25, 1971. The improved composite container disclosed in this patent features the use of a compound material on the metal ends which, when heated, will form a bond with a thermoplastic material incorporated into the inner liner of the composite can body. Thus, this configuration provided both a mechanical double-seamed joint and a chemical-type bond which aided in providing a hermetic seal and withstanding the increased pressure of pressure-producing products. However, it has been found that while the configuration of my U.S. Pat. No. 3,580,464 was a considerable improvement over the existing prior art composite containers, it does not provide the necessary structural integrity required for packaging and shipping certain food items and other pressure-producing products. It has been found that during shipping certain impacts to the side area of the double-seamed end configuration could result in a reduction of the hermetic seal and loss of pressure from within the container.

Thus, there is a continuing need for, and it is an object of this invention to provide, an inexpensive container which provides improved strength to maintain a hermetic seal for successful packaging of food items and pressure-producing products.

Other objects, features and advantages of this invention will become obvious to those skilled in the art upon reference to the following detailed description and the drawings illustrating a preferred embodiment thereof.

SUMMARY OF THE INVENTION

In general, this invention provides a substantially rigid container which may be constructed of fiber, plastic, lightweight metal, or combinations of such materials and which is adapted to provide a strong double-seamed joint between the metal end members and the can body wall. This invention provides for the use of metal ends which include compound material throughout their curl area and extended flange portions on the composite can body to facilitate an improved joint and seal between the metal ends and the can body. In addition, the compound is adapted to form a bond with an inner liner layer on the can body.

IN THE DRAWINGS

DESCRIPTION OF THE PREFERRED EMBODIMENT

Figure 1:
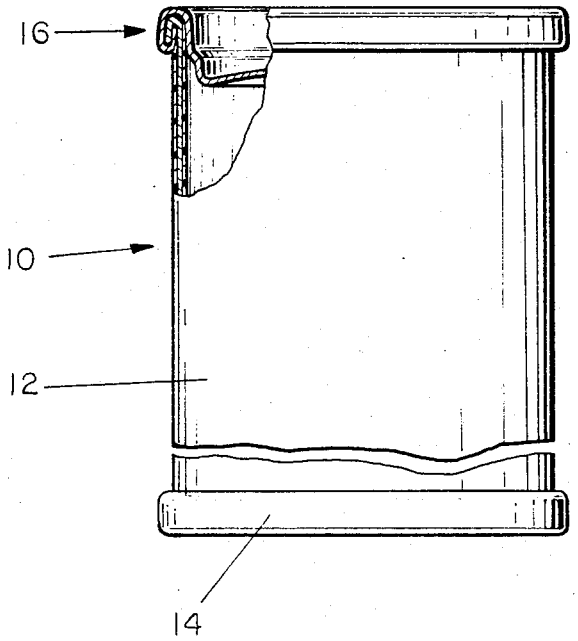
FIG. 1 is a front elevational view of a lightweight composite container with parts broken away in section and incorporating the metal end attaching means of this invention.
Figure 2:
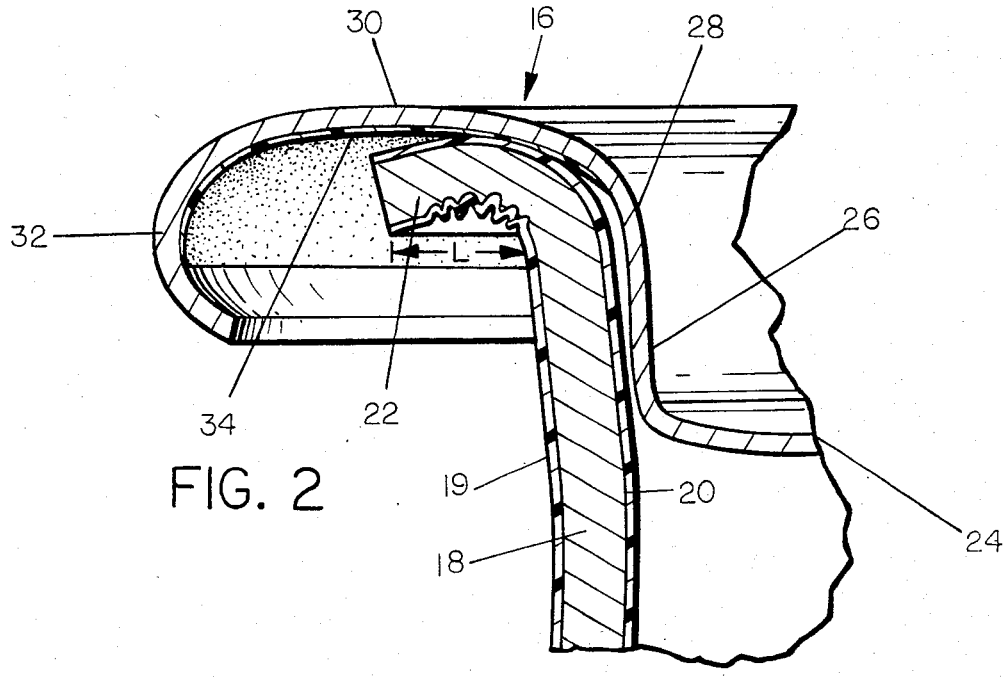
FIG. 2 is an enlarged sectional view of a compounded container end and the extended flange portion of a can body to which it is to be joined.
Figure 3:
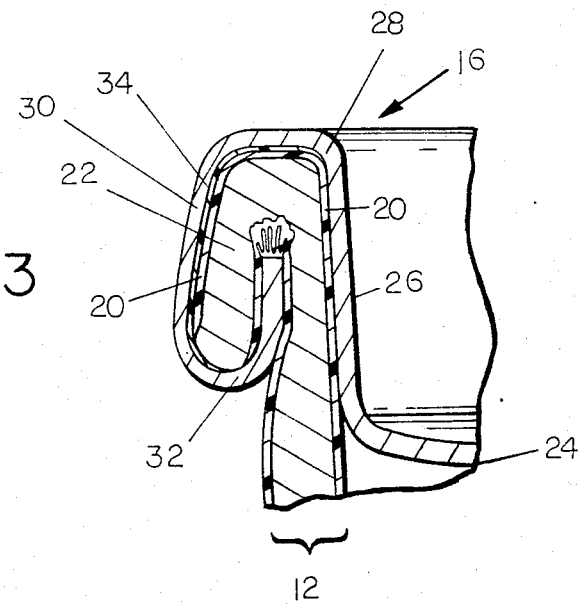
FIG. 3 is a sectional view of the components of FIG. 2 showing them in the final sealed relationship.

Although the preferred embodiment, as shown in FIGS. 1–3, features a composite type container, it should be clear that the invention is equally well-suited to be used in combination with a thin-walled container constructed of plastic and other materials.

More particularly, FIG. 1 shows a cylindrical container 10 formed from a thin-walled composite can body 12 and a pair of metal end closures 14 and 16.

The construction of the cylindrical composite can body 12 can best be seen by reference to FIGS. 2 and 3. The can body 12 is comprised of a layer of structural material 18 sandwiched between an outer label 19 and an inner liner 20 which is laminated or bonded to the inside of the structural material 18. It should be understood that a variety of different materials can be utilized to produce the structural material layer 18, the outer label 19, and the inner liner 20. As examples of suitable such materials, the inner liner 20 may be formed of a lamination of 0.001 in. polypropylene film/0.00035 in. aluminum foil/0.0005 in. low-density polyethylene/and 25 lb. per ream paper, which may be extensible grade kraft paper or ¾ mil surlyn/0.00035 "aluminum foil/0.0005" low-density polytheylene/25 lb. per ream paper. The structural material layer 18 could be formed from a number of layers of can stock grade natural kraft. The outer label 19 may be either 0.001 high-density polyethylene/25 lb. per ream natural kraft paper or 0.0003 aluminum foil/25 lb. per ream natural kraft paper. In addition, 40–55 lb. per ream coated bleached paper grades may also be used as label stock. The high-density polyethylene, aluminum foil, or coated bleached paper in these examples for the outer label 19 would serve as an outer protective coating for the structural material. Likewise, the inner liner 20 formed of polypropylene film, aluminum foil, and low-density polyethylene is positioned so as to be in contact with the product being contained within the container 10 and keeps the product out of contact with the structural layer 18.

An important feature of this invention is the provision of an extended length attaching flange 22 at each end of the fiber can body 12. Typical flange extension obtained in conventional flanging methods now being used in the manufacture of composite cans results in a flange length (see "L" in FIG. 2) of 0.030–0.050 in. measured from outer bodywall surface depending on the can size and the materials used. Flange extension obtained in this invention results in a flange length of 0.075–0.090 in. It is suggested that the can body be formed approximately 3/32 of an inch longer than standard can bodies currently used for the same size can to provide additional material to form the extended length flanges 22. It is further suggested that the extended length flanges 22 be formed as shown in FIG. 2 so that they are positioned in a generally perpendicular relationship with the can body 12.

The metal end closures 14 and 16 are of a standard type used in connection with hermetically sealed cans and may be identical with each other. For the purpose of illustration, FIGS. 2 and 3 depict the sequence of uniting the end closure 16 to the can body 12. It should be understood that the end closure 14 is attached to the opposite end of the can body 12 in an identical procedure. The metal end closure 16, as shown in FIGS. 2 and 3, includes a center panel 24, a chuck wall 26, a shoulder area 28, a seaming panel 30, and a cover hook area 32. An important feature of this invention is the provision of a quantity of compounding composition 34 which is strategically positioned across the entire seaming panel 30 and extends partially into the shoulder area 28 and the cover hook area 32. Such compound normally has been positioned only in the shoulder area of a metal end which is to be double-seamed to a composite can body. Thus, as will be seen in reference to FIG. 3, the use of the extended flange 22 and the positioning of the compound material 34 results in a much increased contact area between the metal end and the can body inner liner when they are double-seamed together to form the configuration of FIG. 3. Although any suitable compound may be used, a recommended example of a suitable such end lining compound is Compound No. 1105, which is manufactured by the Dewey & Almy Chemical Division of W. R. Grace and Company. As can be seen in the transition of FIG. 2 to FIG. 3, when the metal end closure 16 is double-seamed into engagement with the extended flange 22, a structurally sound joint is formed between the metal end closure 16 and the can body 12. The configuration of this invention results in a relatively long surface area contact between the compound material 34 and the inner liner 20 on the can body to thereby form a rather expensive bonding area to create an effective hermetic seal between the metal end closure and the can body. Both internal pressure build-up and physical damage to the end chine area tend to pull the chuck wall area 26 away from the can body, thereby damaging the primary seal which is formed in this area. The subject invention avoids this problem by relocating the primary seal to the extended flange and curl area. These areas tend to be tightened thereby creating an improved primary seal during distortion of the chuck wall area.

Thus, the use of the extended flange 22 and the positioning of the compound 34 creates both an effective hermetic seal and a structural joint having considerably improved strength over previously utilized double-seamed joints. For example, abuse tests comparing the new improved configuration of this invention with a standard double-seamed joint have shown that 26.4% of the standard double-seamed joint cans exhibited a loss of hermetic seal due to damage of the end seam compared with only 2.8% of the cans featuring the improved extended flange concept of this invention.

It should be noted that the metal end closures may be heated as taught in my previously mentioned U.S. Pat. No. 3,580,464 so as to aid in the bonding of the compound material with the inner liner on the fiber can body. However, it has also been found that the use of the extended flange and the postioning of the compound of this invention will provide both a vastly improved hermetic seal and a stronger double-seamed joint even without the specific application of heat when compared with standard double-seamed joints. Hence, it is clear that the unique structure of the subject invention results in a lightweight and inexpensive container which exhibits strength properties heretofor unknown in such containers, and is capable of both providing an improved hermetic seal for food products and withstanding the pressures associated with pressure-producing products, such as carbonated beverages and beer. As a result, the desirable use of inexpensive, lightweight containers has been extended to additional products beyond those that are currently packaged in such containers.

What I claim is:

1. A method of forming an improved, mechanically strong end closure on a plural ply composite container comprising the steps of providing a cylindrical can body of plural ply composite material open at both its opposite axial ends, said can body comprising an inner layer, a structural layer comprised of plural plies of kraft paper, and an outer layer of label material, said can body having a greater axial length than a standard can body of a given size container, forming a radially outwardly turned flange having a length of 0.075 inch or greater on one open end of said can body such that the inner layer, structural layer, and outer layer each extend substantially perpendicular to the outer surface of said can body and the thickness of the flange remains substantially the same throughout as that of the thickness of the remainder of the can body except at the area of juncture of said flange and said can body, positioning a layer of end lining compound on the undersurface of a pair of metal end closures, each of which includes a chuck wall, adjacent shoulder area, seaming panel and cover hook area, said end lining compound extending over said seaming panel, and at least a portion of said hook area and shoulder area, and placing one of said can end closures with the compound thereon on the flange on one open end of the can body such that said flange engages the compound on said shoulder area and said seaming panel and said chuck wall extends axially into the open end of said can body, double-seaming the can end closure and flange together into a seal between the closure and can body such that the flange of the can body extends axially with the inner liner extending along the seaming panel thereby closing the open end of the can, the lining compound forming a primary hermetic annular side seal between said seaming panel of said closure and the inner liner of the flange of said can body, and forming a radially outwardly turned flange having a length of 0.075 inch or greater on the opposite open end of the can body such that the inner layer, structural layer, and outer layer each extend substantially perpendicular to the outer surface of said can body and the thickness of the flange remains substantially the same throughout as that of the thickness of the remainder of the can body except at the area of juncture of said flange and said can body, the other of said pair of can end closures with the compound thereon being adapted for placing it on the flange on said other open end of the can body such that said flange thereon engaging the compound on said shoulder area and said seaming panel and said chuck wall extends axially into the open end of said can body, and adapted for double-seaming the can end closure and said other end flange together into a seal between the closure and can body such that said other flange of the can body extends axially with the inner liner extending along the seaming panel thereby closing the open end of the can, the lining compound forming a primary hermetic annular side seal between said seaming panel of said closure and the inner liner of the flange of said can body.

2. The method set forth in claim 1 including the step of double-seaming the can end closure and said other end flange together into a seal between the closure and can body such that said other flange of the can body extends axially with the inner liner extending along the seaming panel thereby closing the open end of the can, the lining compound forming a primary hermetic annular side seal between said seaming panel of said closure and the inner liner of the flange of said can body.

3. The method set forth in claims 1 or 2 wherein the steps of forming the radially outwardly turned flanges are such that the flanges have a length of 0.075–0.090 inch.

4. A composite can construction comprising a cylindrical can body having an inner liner layer, a layer of structural material including plural layers of kraft paper, and an outer label layer, a metal end closure including a center panel, a chuck wall, and a shoulder area, annular seaming panel area and cover hook area, an annular flange at one end of said can body formed radially outwardly and having a length of 0.075 inch or greater from the outer peripheral surface of said can body and disposed such that the inner layer, structural layer and outer layer extend substantially perpendicular with said outer peripheral surface of said body and the thickness of the flange remains substantially the same throughout as that of the thickness of the remainder of the can body except at the area of juncture of said flange and said can body, and a quantity of compound on the underside surface of said metal end closure extending over the entire seaming panel area and onto the shoulder area and cover hook area thereof, said metal end closure being engageable over the annular flange with said compound disposed therebetween for encircling the open end of said can body, said closure being adapted for a mechanical double-seamed connection with said can body flange such that the flange of the can body extends axially with the inner liner extending along the seaming panel forming a primary hermetic annular side seal of the metal end closure and said can body flange in the area of said compound distribution thereby providing an improved seal on such container end and enhancing the strength of the container at said end connection.

5. The composite container of claim 4 including a second metal end closure including a center panel, a chuck wall, shoulder area, annular seaming panel area and cover hook area, a quantity of compound on the underside surface of said metal end extending over the entire seaming panel area and onto the shoulder and cover hook areas thereof, an annular flange at the other end of said can body like the opposite end flange and characterized by its outward extent from the outer peripheral surface of said can body being 0.075 inch or greater and such that the inner layer, structural layer and outer layer extend substantially perpendicular with said outer peripheral surface of said body and the thickness of the flange remains substantially the same throughout as that of the thickness of the remainder of the can body except at the area of juncture of said flange and said can body, said second metal end closure being engageable over the annular flange on the other end of the can body with said compound disposed therebetween for encircling the other open end of said can body adapted for a mechanical double-seamed connection with said can body flange at its other end of closing the container.

6. The composite can construction set forth in claims 10 or 11 wherein the annular flanges have a length of 0.075–0.090 inch.

* * * * *